US008929753B2

(12) United States Patent
Mine

(10) Patent No.: US 8,929,753 B2
(45) Date of Patent: Jan. 6, 2015

(54) HEATING CONTROL DEVICE, HEATING CONTROL METHOD, AND IMAGE FORMING APPARATUS

(75) Inventor: Ryuta Mine, Toride (JP)

(73) Assignee: Canon Kabushiki Kaisha (JP)

( * ) Notice: Subject to any disclaimer, the term of this patent is extended or adjusted under 35 U.S.C. 154(b) by 307 days.

(21) Appl. No.: 13/100,525

(22) Filed: May 4, 2011

(65) Prior Publication Data

US 2011/0274449 A1 Nov. 10, 2011

(30) Foreign Application Priority Data

May 6, 2010 (JP) ..... 2010-106403

(51) Int. Cl.
*G03G 15/20* (2006.01)
*G03G 15/00* (2006.01)

(52) U.S. Cl.
CPC ..... *G03G 15/5012* (2013.01); *G03G 15/205* (2013.01); *G03G 15/2078* (2013.01); *G03G 15/5004* (2013.01); *G03G 2215/2009* (2013.01); *G03G 2215/2032* (2013.01)
USPC ..... 399/33; 399/67

(58) Field of Classification Search
CPC G03G 15/2039; G03G 15/5004; G03G 15/80
USPC ..... 399/33, 67; 219/663, 665
See application file for complete search history.

(56) References Cited

U.S. PATENT DOCUMENTS 5,229,577 A * 7/1993 Matsuura et al. ..... 219/497
5,481,346 A * 1/1996 Ohzeki et al. ..... 399/335
2004/0265021 A1* 12/2004 Kinouchi et al. ..... 399/334
2005/0058467 A1* 3/2005 Sasamoto et al. ..... 399/67
2008/0002996 A1* 1/2008 Ushiro ..... 399/31

FOREIGN PATENT DOCUMENTS

JP 2007-328159 A 12/2007

* cited by examiner

*Primary Examiner* — Benjamin Schmitt
(74) *Attorney, Agent, or Firm* — Rossi, Kimms & McDowell LLP

(57) ABSTRACT

A heating control device which is capable of detecting an abnormality of an object to be heated accurately. A power-supply unit applies the electric power to the electromagnetic induction heating coil. A magnetic flux detecting unit detects a magnetic flux emitted from the electromagnetic induction heating coil across the object, and outputs a voltage corresponding to the detected magnetic flux. A changing unit changes at least one of the detected magnetic flux voltage value and an abnormality detection threshold value based on relationship between an electric power set value that defines the electric power and an input voltage inputted to the power-supply unit. A determination unit compares the detected magnetic flux voltage value changed by the changing unit to the abnormality detection threshold value, and determines an abnormality of the object when the detected magnetic flux voltage value is larger than the abnormality detection threshold value.

7 Claims, 9 Drawing Sheets

*FIG.7*

| INPUT ELECTRIC POWER Win [W] | Vin ≤ 85V | 85V < Vin ≤ 110V | 110V < Vin ≤ 135V | 135V < Vin ≤ 185V | 185V < Vin ≤ 225V | 225V < Vin ≤ 265V |
|---|---|---|---|---|---|---|
| 1000W < Win ≤ 1200W (1200W) | 0.288 | 0.307 | 0.323 | 0.350 | 0.367 | 0.383 |
| 800W < Win ≤ 1000W (1000W) | 0.240 | 0.256 | 0.269 | 0.292 | 0.306 | 0.319 |
| 600W < Win ≤ 800W (800W) | 0.192 | 0.205 | 0.216 | 0.233 | 0.245 | 0.255 |
| 400W < Win ≤ 600W (600W) | 0.144 | 0.154 | 0.162 | 0.175 | 0.184 | 0.191 |
| 200W < Win ≤ 400W (400W) | 0.096 | 0.102 | 0.108 | 0.117 | 0.122 | 0.128 |
| Win ≤ 200W (200W) | 0.048 | 0.051 | 0.054 | 0.058 | 0.061 | 0.064 |
| (0W) | 85V | 110V | 135V | 185V | 225V | 265V |

INPUT VOLTAGE Vin [V]

HEATING CONTROL DEVICE, HEATING CONTROL METHOD, AND IMAGE FORMING APPARATUS

BACKGROUND OF THE INVENTION

1. Field of the Invention

The present invention relates to a heating control device, a heating control method, and an image forming apparatus that uses the heating control apparatus that can detect an abnormality of an object to be heated while heating the object by electromagnetic induction.

2. Description of the Related Art

An image forming apparatus, such as a copier or a printer, that uses an electrophotography process is provided with a fixing device that heats and melts an unfixed image (for example, an unfixed toner image) formed on a recording sheet such as recording paper sheets etc. to fix the image.

One of such fixing devices heats a fixing belt, which is included in the fixing device, by electromagnetic induction.

The fixing belt of which substrate comprises a magnetic metal layer has endless structure and is rotated. This kind of fixing device has a coil that heats the fixing belt as an object to be heated, a pressure device that contacts with the fixing belt while giving pressure thereto to form a nip position, and a heating control device that controls electric power applied to the coil to control heat generation.

The heating control device generates alternating field by applying electric power to the coil, generates an eddy current in the substrate of the fixing belt by this alternating field, and heats the fixing belt with Joule heat generated by this eddy current.

Then, when a recording sheet on which an unfixed toner image is conveyed to the nip position, the heating control device heats and fixes the unfixed toner image onto the recording sheet by the heat of the fixing belt.

Incidentally, the fixing belt that generates heat by electromagnetic induction heating may be damaged by prolonged use. When the fixing belt is damaged, an unfixed toner image cannot be fixed completely.

For example, since the number of sheets processed by an image processing job (for example, a copy job) of an image forming apparatus may amount to 1000, when the copy job is executed with a damaged fixing belt, a large amount of imperfect copies will occur, which wastes recording sheets and toner.

Accordingly, a conventional heating control device is equipped with a means for detecting abnormalities of the fixing belt. The heating control device is provided with an antenna that generates voltage or current corresponding to a magnetic flux from the coil, and determines that the fixing belt is damaged when an output value of the antenna exceeds a predetermined threshold value. Then, when determining that the fixing belt is damaged, the heating control device makes the image forming apparatus interrupt a job under operating condition in order not to waste recording sheets and toner.

FIG. 10 is a graph showing an example of a relationship between the output value of the antenna (referred to as an antenna output, hereafter) and a percentage of an abnormality area in the fixing belt (a proportion of an abnormality area in one fixing belt) in the conventional heating control device.

In FIG. 10, a horizontal axis shows the percentage (%) of the abnormality area in the fixing belt, and the vertical axis shows the antenna output Va (V). The heating control device determines that the fixing belt is damaged when the antenna output Va exceeds the predetermined threshold value. Then, the conventional heating control device sets the abnormality detection threshold value for the antenna output Va according to an electric power set value showing the electric power applied to the coil. It should be noted that the abnormality detection threshold value for the antenna output Va is determined according to the antenna output Va at which the percentage of the abnormality area in the fixing belt becomes 25%.

As shown in FIG. 10, when the electric power set value is 1200 W (the maximum electric power; shown by a straight line 10*c*), the abnormality detection threshold value of the antenna output Va is set to the antenna output Va=0.30 V at which the percentage of the abnormality area in the fixing belt becomes 25%. Similarly, when the electric power set value is 600 W (a half of the maximum electric power; shown by a straight line 10*b*), the abnormality detection threshold value of the antenna output Va is set to the antenna output Va=0.15 V. When the electric power set value is 300 W (a quarter of the maximum electric power; shown by a straight line 10*a*), the abnormality detection threshold value is set to the antenna output Va=0.075 V.

Then, the heating control device compares the antenna output Va with the abnormality detection threshold value that has been set according to the electric power set value during a heating-fixing operation of the fixing device. Then, when the antenna output Va exceeds the abnormality detection threshold value concerned, the heating control device determines that the fixing belt is damaged (for example, see Japanese Laid-Open Patent Publication (Kokai) No. 2007-328159 (JP 2007-328159A)).

However, the antenna output Va increases with increasing the input voltage to the coil even if the electric power set value (i.e., the electric power) does not change. Therefore, when the abnormality detection threshold value of the antenna output Va is set according to only the electric power set value, variation of the input voltage changes a criterion of determination for the damage to the fixing belt.

Particularly, when an image forming apparatus is made universal and a range of a usable alternating voltage (an AC input voltage) spreads from the commercial voltage 100 V in Japan to the overseas commercial voltage 240 V, the criterion of determination for the damage to the fixing belt differs greatly.

Therefore, when the heating control device tries to determine damage to the fixing belt in consideration of the range of the AC input voltage, it is necessary to set the abnormality detection threshold value more highly than the case where the AC input voltage is 100 V. As a result, there is a problem that the damage to the fixing belt is not determined unless the percentage of the abnormality area in the fixing belt becomes too large, when the AC input voltage is 100 V.

SUMMARY OF THE INVENTION

The present invention provides a heating control device, a heating control method, and an image forming apparatus using the heating control apparatus, which are capable of detecting an abnormality of an object to be heated accurately.

Accordingly, a first aspect of the present invention provides a heating control device that applies electric power to an electromagnetic induction heating coil to control heating an object to be heated by the electromagnetic induction heating coil, comprising a power-supply unit configured to apply the electric power to the electromagnetic induction heating coil, a magnetic flux detecting unit configured to detect a magnetic flux emitted from the electromagnetic induction heating coil, and to output a voltage corresponding to the detected magnetic flux as a detected magnetic flux voltage value, a changing unit configured to change at least one of the detected magnetic flux voltage value and an abnormality detection threshold value based on relationship between an electric power set value that defines electric power value of the electric power and an input voltage inputted to the power-supply unit, and a determination unit configured to compare the detected magnetic flux voltage value that is changed by the changing unit to the abnormality detection threshold value, and to determine an abnormality of the object to be heated when the detected magnetic flux voltage value is larger than the abnormality detection threshold value.

Accordingly, a second aspect of the present invention provides a heating control method for applying electric power to an electromagnetic induction heating coil to control heating an object to be heated by the electromagnetic induction heating coil, comprising a magnetic flux detecting step of detecting a magnetic flux emitted from the electromagnetic induction heating coil, and to output a voltage corresponding to the detected magnetic flux as a detected magnetic flux voltage value, a changing step of changing at least one of the detected magnetic flux voltage value and an abnormality detection threshold value based on relationship between an electric power set value that defines electric power value of the electric power and an input voltage inputted to the power-supply unit, and a determination step of comparing the detected magnetic flux voltage value that is changed by the changing unit to the abnormality detection threshold value, and of determining an abnormality of the object to be heated the detected magnetic flux voltage value is larger than the abnormality detection threshold value.

Accordingly, a third aspect of the present invention provides an image forming apparatus, comprising a transfer unit configured to transfer a toner image to a recording sheet, and the heating control device of the first aspect that applies electric power to an electromagnetic induction heating coil to control heating when the toner image transferred onto the recording sheet is heated and fixed.

According to the present invention, an abnormality of an object to be heated can be detected accurately.

Further features of the present invention will become apparent from the following description of exemplary embodiments with reference to the attached drawings.

BRIEF DESCRIPTION OF THE DRAWINGS

FIG. 7 is a view showing an example of an abnormality detection threshold value table used in the heating control device shown in FIG. 4.

DESCRIPTION OF THE EMBODIMENTS

Hereafter, a heating control device according to an embodiment of the present invention will be described with reference to the attached drawings. Although a case where a fixing belt in a fixing device used in an image forming apparatus is an object to be heated will be described here, the heating control device according to the embodiment of the present invention can be similarly used for an object other than the fixing belt as long as it is necessary to detect an abnormality of the object to be heated.

Figure 1:
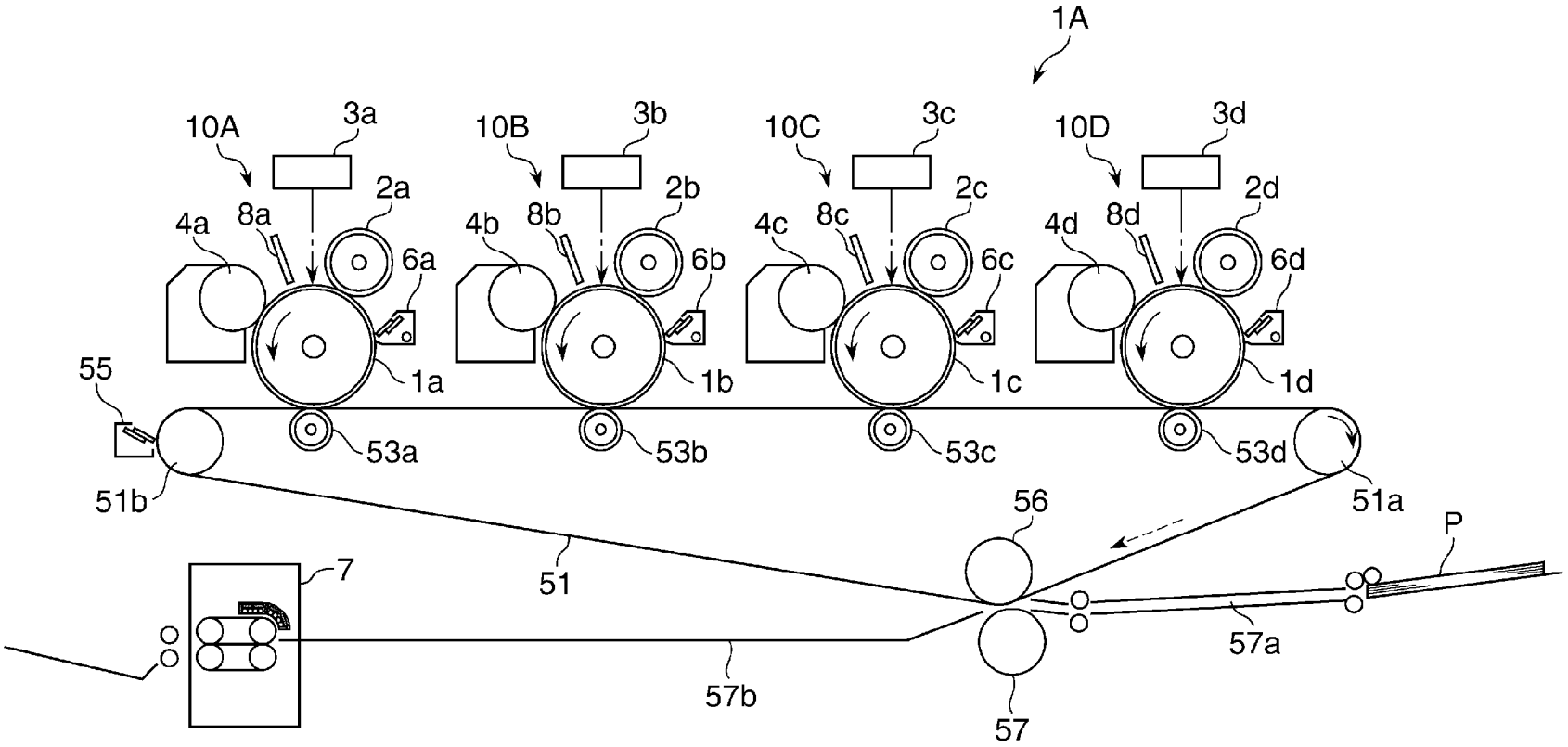
FIG. 1 is a view schematically showing an example of an image forming apparatus using a heating control apparatus according to an embodiment of the present invention.

First, the image forming apparatus will be described with reference to FIG. 1. FIG. 1 is a view schematically showing an example of the image forming apparatus 1A using the heating control apparatus according to the embodiment of the present invention.

The illustrated image forming apparatus 1A can form a color image or a monochrome image using an electrophotography process, for example. It should be noted that the image forming apparatus 1A employs a tandem system.

The image forming apparatus 1A has first, second, third, and fourth image forming units 10A, 10B, 10*c*, and 10D. Then, the first, second, third, and fourth image forming units 10A, 10B, 10*c*, and 10D are provided with photoconductive drums 1*a*, 1*b*, 1*c*, and 1*d*, respectively. Primary charging units 2*a*, 2*b*, 2*c*, and 2*d*, exposure units 3*a*, 3*b*, 3*c*, and 3*d*, developing units 4*a*, 4*b*, 4*c*, and 4*d*, and cleaners 6*a*, 6*b*, 6*c*, and 6*d* are arranged around the photoconductive drums 1*a*, 1*b*, 1*c*, and 1*d*, respectively.

Each of the developing units 4*a*, 4*b*, 4*c*, and 4*d* stores yellow (Y) toner, magenta (M) toner, cyan (C) toner, and black (Bk) toner, for example.

It should be noted that, in the illustrated example, potential sensors 8*a*, 8*b*, 8*c*, and 8*d* are arranged around the photoconductive drums 1*a*, 1*b*, 1*c*, and 1*d* between the exposure units 3*a*, 3*b*, 3*c*, and 3*d* and the developing units 4*a*, 4*b*, 4*c*, and 4*d*, respectively. Then, the potential sensors 8*a*, 8*b*, 8*c*, and 8*d* detect surface potentials of the photoconductive drums 1*a*, 1*b*, 1*c*, and 1*d*, respectively.

As shown in FIG. 1, primary transfer rollers 53*a*, 53*b*, 53*c*, and 53*d* are arranged so as to face the photoconductive drums 1*a*, 1*b*, 1*c*, and 1*d*, respectively. An intermediate transfer belt 51 is arranged through nip positions between the photoconductive drums 1*a*, 1*b*, 1*c*, and 1*d* and the primary transfer rollers 53*a*, 53*b*, 53*c*, and 53*d*. The intermediate transfer belt 51 is rotated in a direction shown by a dotted line arrow.

That is, the intermediate transfer belt 51 is looped over a driving roller 51*a*, a driven roller 51*b*, and a first secondary transfer roller 56, and is driven by the driving roller 51*a* so as to rotate in the direction shown by the dotted line arrow.

A second secondary transfer roller 57 is arranged so as to face the first secondary transfer roller 56. A secondary transfer section is prescribed by these secondary transfer rollers 56 and 57. Then, the intermediate transfer belt 51 passes this secondary transfer section. It should be noted that an intermediate transfer belt cleaner 55 is arranged so as to face the driven roller 51*b*.

A recording sheet P is conveyed to the secondary transfer section through a first recording sheet passage 57*a*, and the recording sheet P that passed the secondary transfer section is conveyed to a fixing device 7 through a second recording sheet passage 57*b*.

Here, an image forming operation in the illustrated image forming apparatus 1A will be described. Since operations of the first, second, third, and fourth image forming units 10A, 10B, 10C, and 10D are identical, the operation will be described while focusing on the first image forming unit 1A.

The photoconductive drum 1*a* is rotated in a direction shown by a solid line arrow. The surface of the photoconductive drum 1*a* is uniformly charged by the primary charging unit 2*a*. Then, the exposure unit 3*a* exposes the surface of the photoconductive drum 1*a* according to an image signal (image data) to form an electrostatic latent image on the photoconductive drum 1*a*.

Next, the developing unit 4*a* develops the electrostatic latent image to form a toner image (here for example, a yellow toner image). The toner image on the photoconductive drum 1*a* is transferred by the primary transfer roller 53*a* as a primary transferred image onto the intermediate transfer belt 51.

Then, excess toner that remains on the photoconductive drum 1*a* is removed by the cleaner 6*a*, the surface of the photoconductive drum 1*a* is again charged uniformly by the primary charging unit 2*a*, and the same process is executed.

The second, third, and fourth image forming units 10B, 10C, and 10D transfer toner images as primary transferred images onto the intermediate transfer belt 51 in the same manner. In this case, the second, third, and fourth image forming units 10B, 10C, and 10D perform primarily transfer in synchronism with the rotation of the intermediate transfer belt 51. Accordingly, a color toner image is formed on the intermediate transfer belt 51.

The color toner image on the intermediate transfer belt 51 is transferred by the secondary transfer section as a secondary transferred image onto the recording sheet P that is conveyed through the first recording sheet passage 57*a* so as to time to the rotation of the intermediate transfer belt 51.

Then, the recording sheet P reaches the fixing device 7 through the second recording sheet passage 57*b*, and the secondary transferred image on the recording sheet P is fixed here. That is, a fixing process of the secondary transferred image formed on the recording sheet P is performed. Then, the recording sheet P is ejected to a paper ejection tray (not shown).

It should be noted that excess toner that remains on to the intermediate transfer belt 51 is removed and collected by the intermediate transfer belt cleaner 55.

Figure 2:
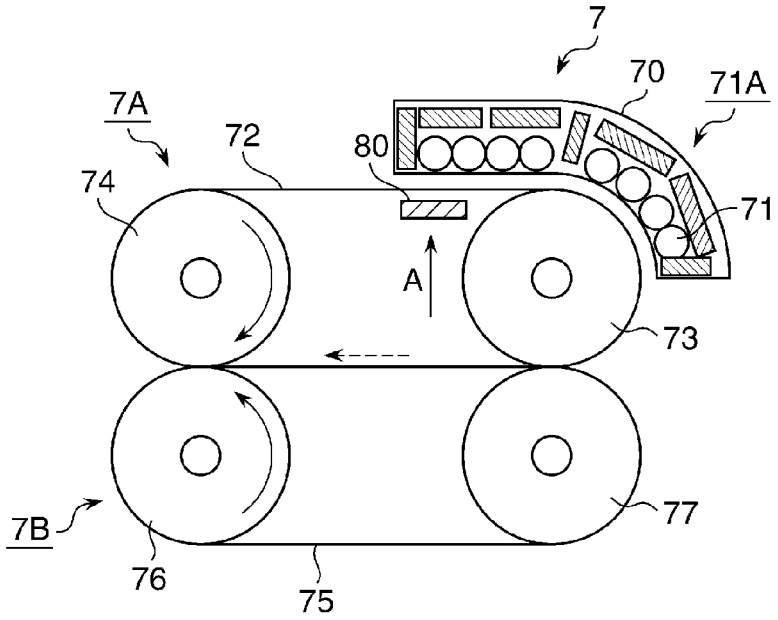
FIG. 2 is a view schematically showing an example of a fixing device used in the image forming apparatus shown in FIG. 1.

FIG. 2 is a view schematically showing an example of the fixing device 7 used in the image forming apparatus 1A shown in FIG. 1.

As shown in FIG. 2, the illustrated fixing device 7 of a diagram carries out the heating fixing of the secondary transferred image on recording sheet P by electromagnetic induction heating. The fixing device 7 has first and the second fixing units 7A and 7B. These first and the second fixing units 7A and 7B are arranged closely to each other.

The first fixing unit 7A has a pair of roller shafts (made of metal) 73 and 74, which are arranged with a predetermined spacing therebetween in the conveyance direction of the recording sheet P, and an endless fixing belt 72 that is looped over these roller shafts 73 and 74.

The illustrated fixing belt 72 contains conductive heating material. The roller shaft 74 is rotated by a driving device (not shown in FIG. 2) in the direction shown by a solid line arrow. This rotates the fixing belt 72 in the direction shown by a dotted line arrow.

Similarly, the second fixing unit 7B has a pair of roller shafts (made of metal) 76 and 77, which are arranged with a predetermined spacing therebetween in the conveyance direction of the recording sheet P, and an endless fixing belt 75 that is looped over these roller shafts 76 and 77.

The fixing belt 75 contains conductive heating material. The roller shaft 76 is rotated by a driving device (not shown in FIG. 2) in the direction shown by a solid line arrow. This rotates the fixing belt 75 in the direction shown by the dotted line arrow.

As shown in FIG. 2, the fixing belts 72 and 75 contact mutually, and the recording sheet P passes through an area prescribed by the contact surface of the fixing belts 72 and 75.

A coil unit 71A is arranged so as to face the fixing belt 72. Specifically, the coil unit 71A is arranged so as to face the fixing belt 72 by covering a part of the roller shaft 73 and a part of the fixing belt 72.

This coil unit 71A has a coil holder 70 and a coil (an electromagnetic induction coil) 71 that is arranged in the coil holder 70. Then, AC power is applied to the coil 71 from a power-supply unit mentioned later. Thus, the coil 71 generates a magnetic field (an alternating field). Then, this magnetic field causes self-heating of the conductive heating material of the fixing belt 72 and the roller shaft 73.

The first fixing unit 7A has an antenna (for example, a loop antenna) 80 that is arranged so as to face the coil unit 71A and to interpose the fixing belt 72 therebetween. This antenna 80 catches a leakage flux that reaches the antenna 80 without interrupting by the fixing belt 72 among the magnetic flux generated by the coil 71.

Figure 3:
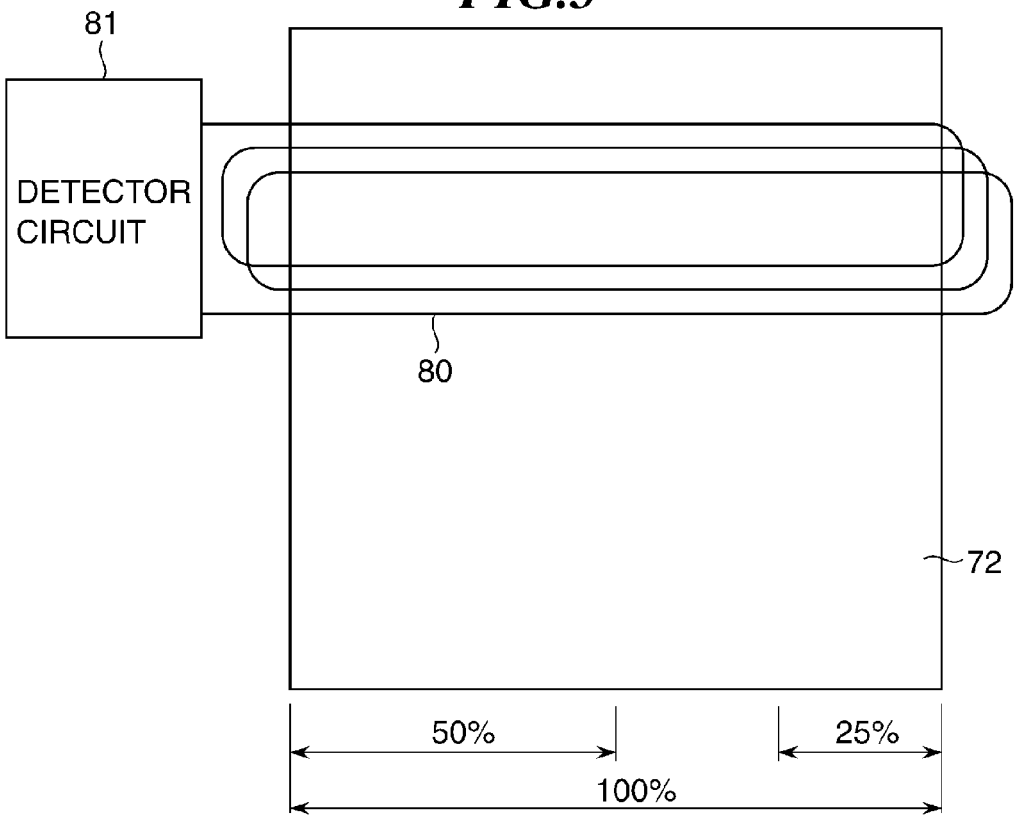
FIG. 3 is a view showing an arrangement of an antenna of the heating control device used in the fixing device shown in FIG. 2.

FIG. 3 is a view showing an arrangement of the antenna 80 of a heating control device used in the fixing device 7 shown in FIG. 2. It should be noted that FIG. 3 shows an arrangement of the antenna 80 viewing the antenna 80 in a direction of a thick line arrow A in FIG. 2.

As shown in FIG. 3, the width of the antenna 80 is larger than that of the fixing belt 72, and the antenna 80 is arranged so as to fully cover the fixing belt 72 in the width direction. Then, a detector circuit 81 is connected to this antenna 80.

The detector circuit 81 detects the leakage flux caught by the antenna 80. Then, the detector circuit 81 converts the AC signal corresponding to the magnitude and direction of the leakage flux outputted from the antenna 80 into a DC voltage, and outputs the DC voltage as an antenna output Va (a detected magnetic flux voltage value).

Figure 4:
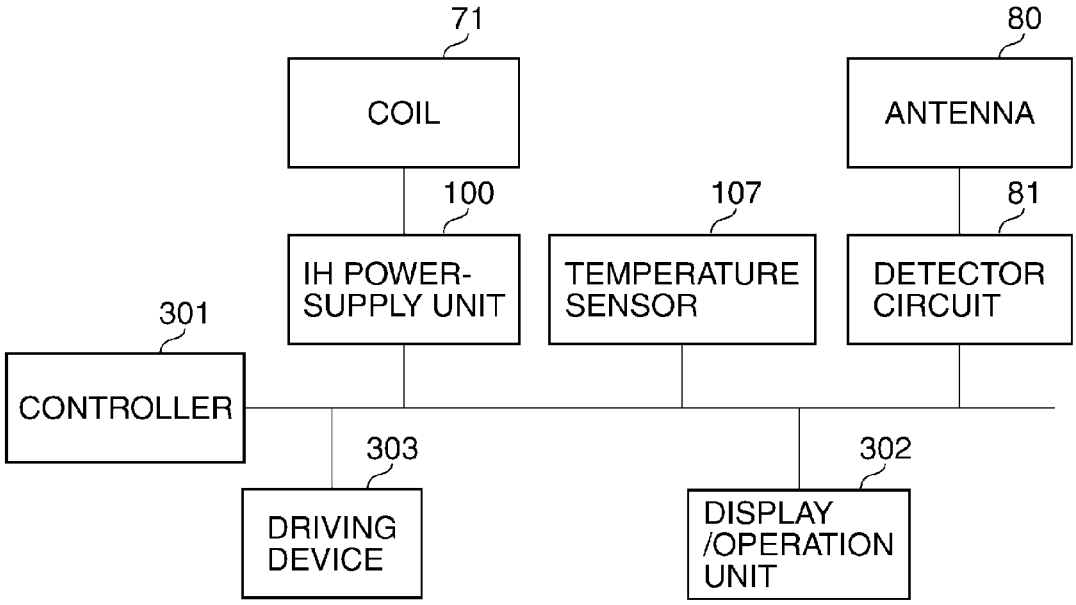
FIG. 4 is a block diagram schematically showing the heating control device used in the fixing device shown in FIG. 2.

FIG. 4 is a block diagram schematically showing the heating control device used in the fixing device shown in FIG. 2.

As shown in FIG. 4, an electromagnetic induction heating (IH) power-supply unit 100 is connected to the coil (it is also referred to as an IH coil) 71 shown in FIG. 2. Then, the IH power-supply unit 100 and the detector circuit 81 are mutually connected via a signal line, and a temperature sensor 107 mentioned later is connected to this signal line. A controller 301 is connected to this signal line.

A driving device 303 and a display/operation unit 302 are connected to the signal line. The driving device 303 drives the above-mentioned roller shafts 74 and 76 under control of the controller 301. The display/operation unit 302 gives various instructions from a user to the controller 301 and displays variety of information from the controller 301.

Figure 5:
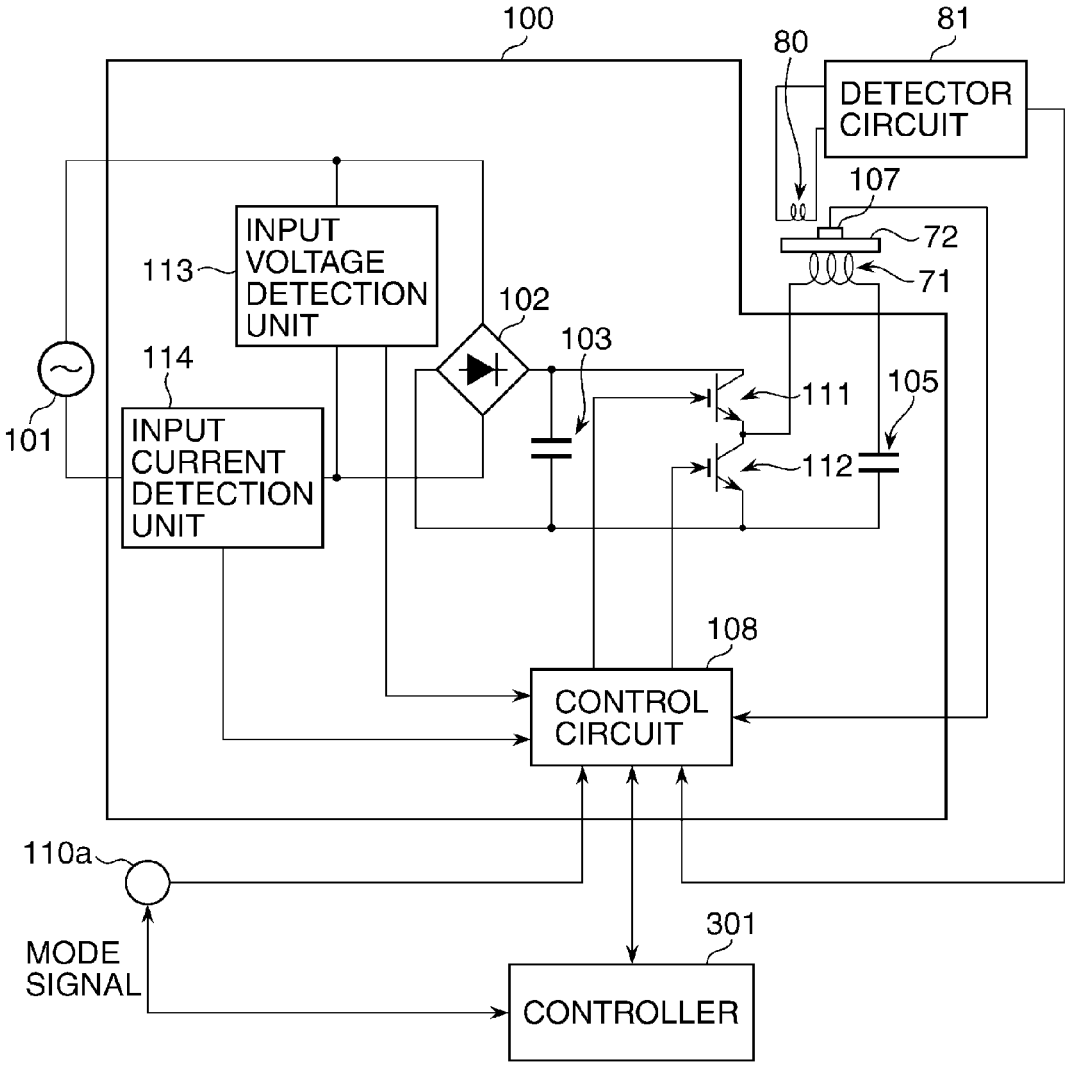
FIG. 5 is a circuit diagram showing an example of an IH power-supply unit used in the heating control device shown in FIG. 4.

FIG. 5 is a circuit diagram showing an example of the IH power-supply unit 100 used in the heating control device shown in FIG. 4.

As shown in FIG. 5, the IH power-supply unit 100 is a series resonance type, and commercial alternating current power 101 is connected to this IH power-supply unit 100.

As shown in FIG. 5, the IH power-supply unit 100 has a diode bridge circuit 102, a filtering capacitor 103, a resonance capacitor 105, a control circuit 108, first and second switch elements (for example, an insulated gate bipolar transistor (IGBT)) 111 and 112, an input voltage detection unit 113, and an input current detection unit 114.

In the IH power-supply unit 100, the input voltage detection unit 113 is connected in parallel to the commercial alternating current power 101, and the input current detection unit 114 is connected in series to the commercial alternating current power 101. An input side of the diode bridge circuit 102 is connected in parallel to the input voltage detection unit 113.

The input voltage detection unit 113 and the input current detection unit 114 detect the input voltage and input current of the commercial alternating current power 101 and output an input voltage detection signal and an input current detection signal, respectively.

Then, the filtering capacitor 103 is connected in parallel to an output side of the diode bridge circuit 102. The first and second switch elements 111 and 112, which are connected in series, are connected in parallel to the filtering capacitor 103.

An emitter of the first switch element 111 is connected to a collector of the second switch element 112, and a collector of the first switch element 111 is connected to the diode bridge circuit 102. A node of the first and the second switch elements 111 and 112 is connected to the above-mentioned coil 71. An emitter of the second switch element 112 is connected to the diode bridge circuit 102, and is connected to the coil 71 via the resonance capacitors 105.

A mode signal mentioned later is given to the control circuit 108 from a mode terminal 110*a*. The above-mentioned input voltage detection signal and the input current detection signal are given to the control circuit 108. The antenna output Va (the detected magnetic flux voltage value) is given to the control circuit 108 from the detector circuit 81.

As shown in FIG. 5, the temperature sensor 107 for detecting the temperature of the fixing belt 72 is arranged in contact with the fixing belt 72, and the temperature detection signal that shows the temperature of the fixing belt 72 detected by the temperature sensor 107 is given to the control circuit 108.

The control circuit 108 gives first and second control signals (pulse signals) to gates of the first and second switch elements 111 and 112 in response to the mode signal, the input voltage detection signal, the input current detection signal, the temperature detection signal, and the antenna output Va. Then, ON/OFF conditions of the first and second switch elements 111 and 112 are controlled by the first and second control signals (the control is mentioned later).

It should be noted that the controller 301 gives the mode signal to the IH power-supply unit 100 via the mode terminal 110*a*. The mode signal is separated into an electric power control mode signal that shows an electric power control mode and a temperature control mode signal that shows a temperature control mode.

In general, the electric power control mode is set in a period of starting to heat the fixing belt 72 to a target temperature, such as a period of starting to heat the fixing belt 72 from a low temperature to the target temperature. And once reaching to the target temperature, the mode is changed to the temperature control mode to keep the target temperature.

When the electric power control mode signal is given from the controller 301, the control circuit 108 operates in the electric power control mode. In the electric power control mode, the control circuit 108 calculates input electric power according to the input voltage detection signal and the input current detection signal. Then, the control circuit 108 controls the ON/OFF conditions of the first and second switch elements 111 and 112 according to the calculated input electric power so that the electric power applied to the coil 71 agrees with a predetermined electric power value.

On the other hand, when the temperature control mode signal is given from the controller 301, the control circuit 108 operates in the temperature control mode. In the temperature control mode, the control circuit 108 controls to keep the surface temperature of the fixing belt 72 constant according to the temperature detection signal from the temperature sensor 107.

That is, the control circuit 108 controls the ON/OFF conditions of the first and second switch elements 111 and 112 so that the detected temperature indicated by the temperature detection signal inputted from the temperature sensor 107 agrees with the predetermined temperature.

It should be noted that the controller 301 shown in FIG. 4 controls the entire system of the image forming apparatus 1A shown in FIG. 1. Although this embodiment shows the configuration in which the controller 301 shown in FIG. 4 and the control circuit 108 shown in FIG. 5 are independently constituted and the control circuit 108 is included in the IH power-supply unit 100, the controller 301 and the control circuit 301 can be unified into one microprocessor.

Figure 6:
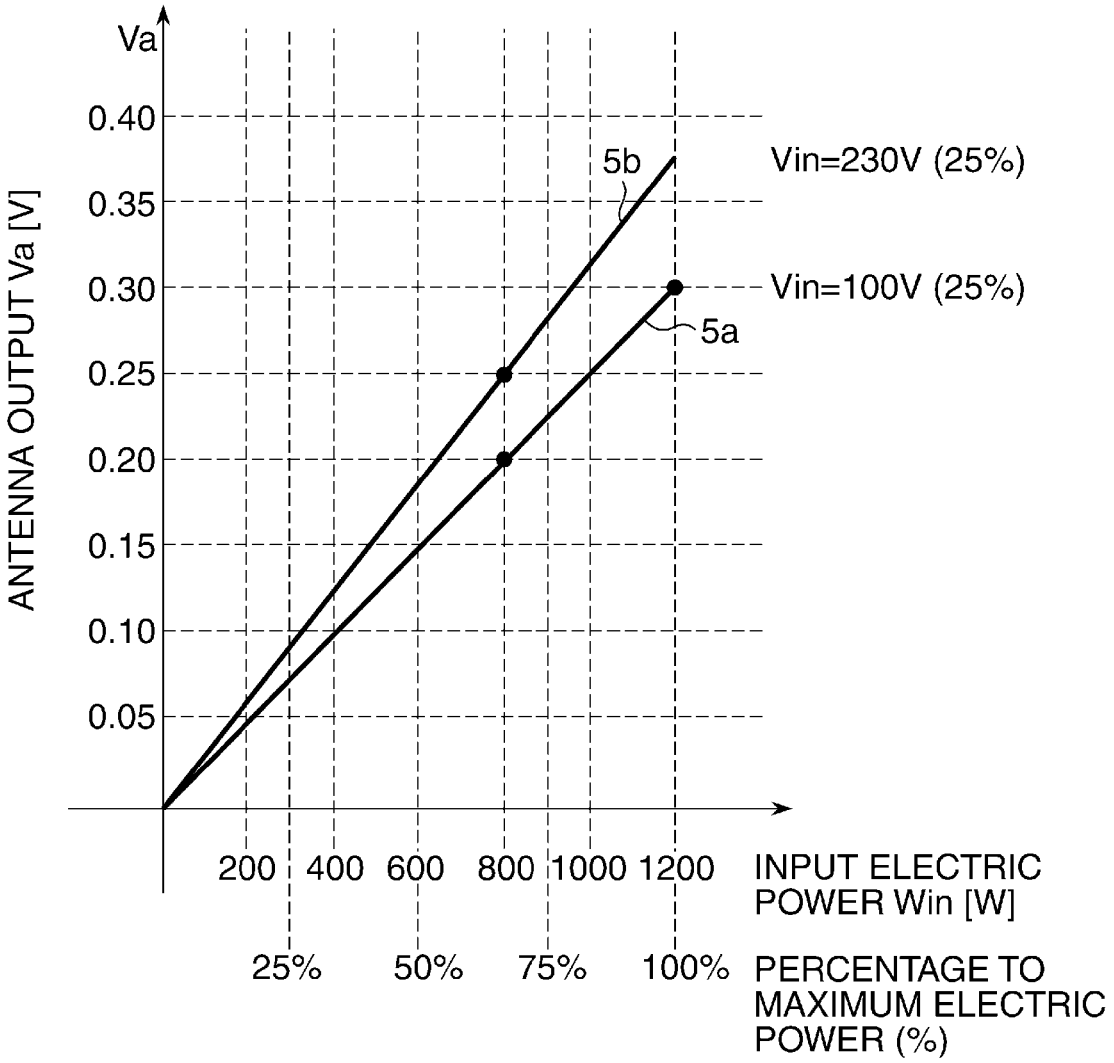
FIG. 6 is a graph showing an example of an output characteristic of the antenna used in the heating control device shown in FIG. 4.

FIG. 6 is a graph showing an example of an output characteristic of the antenna used in the heating control device shown in FIG. 4.

In FIG. 6, a horizontal axis shows the input electric power Win (W) to the IH power-supply unit 100 and the percentage (%) to the maximum electric power, and a vertical axis shows the antenna output Va of the antenna 80. Then, a straight line 5*a* expresses an example of relationship between the input electric power Win and the antenna output Va, when abnormalities occur in 25% (¼) area of the fixing belt 72 and when the input voltage Vin to the IH power-supply unit 100 is 100 V.

A straight line 5*b* expresses an example of relationship between the input electric power Win and the antenna output Va, when abnormalities occur in 25% (¼) area of the fixing belt 72 and when the input voltage Vin to the IH power-supply unit 100 is 230 V.

As mentioned above, the antenna 80 generates the output in response to the change of magnetic flux interlinked with the antenna 80. Then, this magnetic flux is generated in response to the current that flows in the coil 71.

Even if the IH power-supply unit 100 controls the input electric power Win to be the predetermined electric power value, the change of the input voltage Vin changes the electric current waveform that flows in the coil 71. Therefore, even if the input electric power Win is controlled to be the predetermined electric power value, the change of the input voltage Vin changes the antenna output Va outputted from the detector circuit 81.

For example, the antenna output Va corresponding to occurrence of abnormalities in 25% (¼) area of the fixing belt 72 is 0.25 V when the input voltage Vin=230 V and the input electric power Win=800 W.

On the other hand, the antenna output Va corresponding to occurrence of abnormalities in 25% (¼) area of the fixing belt 72 is 0.20 V when the input voltage Vin=100 V and the input electric power Win=800 W.

The antenna output Va corresponding to occurrence of abnormalities in 25% (¼) area of the fixing belt 72 is 0.30 V when the input voltage Vin=100 V and the input electric power Win 1200 W.

Thus, the antenna output Va corresponding to occurrence of abnormalities in 25% area of the fixing belt 72 varies as the input voltage Vin or the input electric power Win changes.

FIG. 7 is a view showing an example of an abnormality detection threshold value table used in the heating control device shown in FIG. 4.

The abnormality detection threshold value table shown in FIG. 7 expresses the antenna output Va corresponding to occurrence of abnormalities in 25% area of the fixing belt 72 as an abnormality detection threshold value.

This abnormality detection threshold value table is used to set the abnormality detection threshold value in response to the input voltage Vin and the input electric power Win to the IH power-supply unit 100. In the illustrated example, both of the input voltage Vin and the input electric power Win are divided into six steps.

Specifically, the input voltage Vin is divided into the following six steps.

Vin≤85V
85V<Vin≤110V
110V<Vin≤135V
135V<Vin≤185V
185V<Vin≤225V
225V<Vin≤265V

The input electric power Win is divided into the following six steps.

Win≤200 W
200 W<Win≤400 W
400 W<Win≤600 W
600 W<Win≤800 W
800 W<Win≤1000 W
1000 W<Win≤1200 W

Since the above-mentioned classification of steps is an example, the steps may be defined more finely.

As shown by a thick line rectangle in FIG. 7, when the input voltage Vin is larger than 110 V and is not larger than 135 V, and when the input electric power Win is larger than 600 W and is not larger than 800 W, the abnormality detection threshold value is set to 0.216 V. In this case, when the antenna output Va exceeds 0.216 V, the control circuit 108 determines that abnormalities occur in not less than 25% area of the fixing belt 72, and that the fixing belt 72 is damaged.

Figure 8:
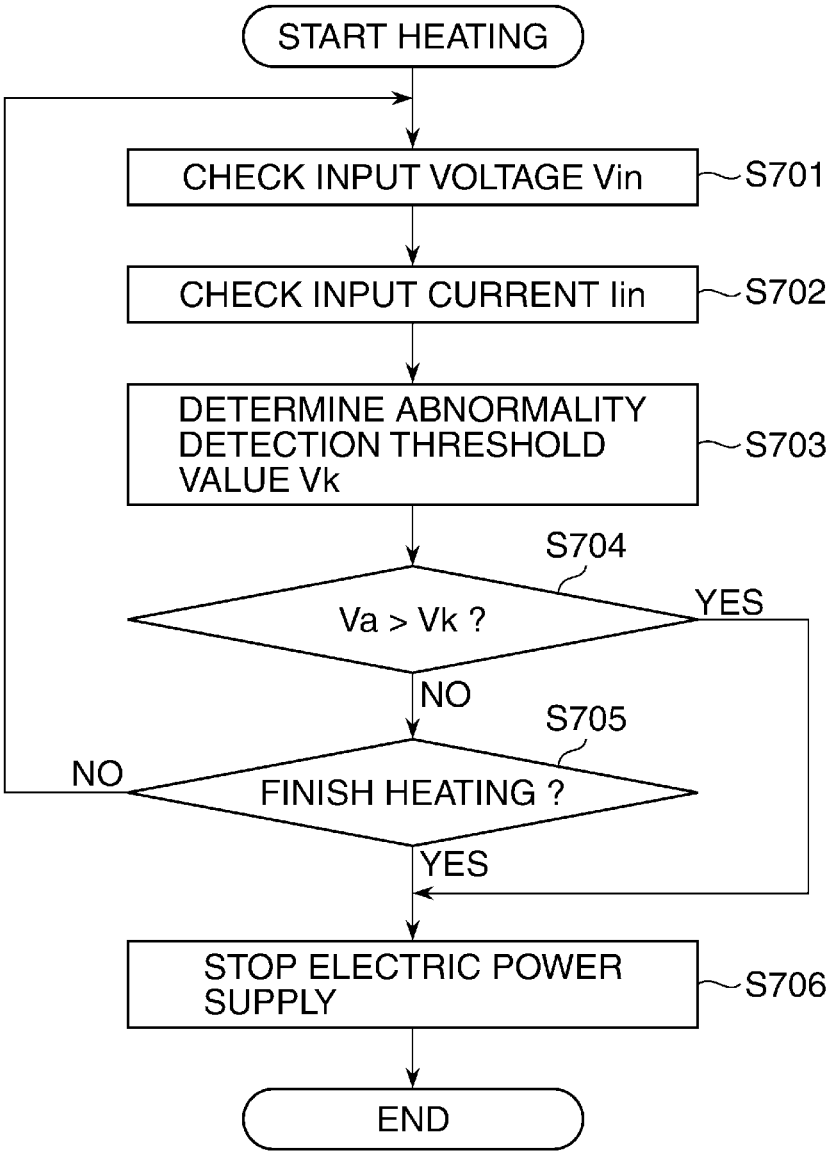
FIG. 8 is a flowchart showing a process for detecting an abnormality of a fixing belt executed by the heating control device shown in FIG. 4.

FIG. 8 is a flowchart showing a process for detecting an abnormality of the fixing belt executed by the heating control device shown in FIG. 4.

The operation will be described with reference to FIG. 1, FIG. 2, FIG. 4, FIG. 5, FIG. 7, and FIG. 8. When the image forming apparatus 1A starts an image forming operation, the controller 301 gives a heating operation start signal to the IH power-supply unit 100. Receiving the heating operation start signal, the control circuit 108 of the IH power-supply unit 100 applies high-frequency electric power to the coil 71. The control circuit 108 of the IH power-supply unit 100 executes the abnormality detection for the fixing belt 72 as follows. It should be noted that the heating operation start signal is always outputted during the image forming operation to keep the fixing belt 72 at high temperature.

In the illustrated example, the abnormality detection threshold value table shown in FIG. 7 is stored in a storage unit (not shown) contained in the control circuit 108.

First, the control circuit 108 acquires the input voltage detection signal from the input voltage detection unit 113 in order to check the input voltage Vin applied to the IH power-supply unit 100 (check input voltage Vin, step S701). Next, the control circuit 108 acquires the input current detection signal from the input current detection unit 114 in order to check the input current Iin applied to the IH power-supply unit 100 (check input current Iin, step S702).

Here, Vin denotes the input voltage that is represented by the input voltage detection signal, and Iin denotes the input current that is represented by the input current detection signal. The control circuit 108 calculates the input electric power Win=Vin*Iin based on the input voltage detection signal and the input current detection signal.

Then, the control circuit 108 determines the abnormality detection threshold value Vk with reference to the abnormality detection threshold value table shown in FIG. 7 according to the input voltage Vin and the input electric power Win (step S703).

For example, when the input voltage Vin is 115 V and the input current Iin is 6 A, the input electric power Win becomes 690 W. Then, the control circuit 108 determines that the abnormality detection threshold value Vk is 0.216V with reference to the abnormality detection threshold value table based on the input voltage Vin=115V and the input electric power Win=690 W. Next, the control circuit 108 compares the antenna output Va (V) given by the detector circuit 81 to the abnormality detection threshold value Vk (V) (step S704).

When the antenna output Va exceeds the threshold value Vk (YES in the step S704), the control circuit 108 determines that the fixing belt 72 has damaged. Then, the control circuit 108 turns OFF the first and second switch elements 111 and 112 to stop supplying the electric power to the coil 71 (stop electric power supply, step S705).

When determining that the fixing belt 72 has damaged, the control circuit 108 notifies the controller 301 (FIG. 4) of the damage of the fixing belt 72 and the stop of the IH power-supply unit 100.

This makes the controller 301 stop the fixing belt 72 driven by the driving device 303. The controller 301 indicates that the fixing belt 72 has damaged on the display/operation unit 302.

On the other hand, when the antenna output Va is not larger than the abnormality detection threshold value Vk (NO in the step S704), the control circuit 108 notifies the controller 301 of normalcy of the fixing belt 72. Then, the control circuit 108 determines whether the detected temperature represented by the temperature detection signal from the temperature sensor 107 reached the predetermined temperature. That is, the controlling circuit 108 determines whether the heating is finished (step S706).

When the image forming operation is completed and the heating operation start signal is not outputted (YES in the step S706), the control circuit 108 proceeds with the process to step S705 and stops electric power supply.

When the image forming operation continues (NO in the step S706), i.e., when the heating operation start signal is outputted, the control circuit 108 proceeds with the process to the step S701 and repeats the check of the input voltage Vin.

As mentioned above, the control circuit 108 always checks the input voltage Vin and the input current Iin during the heating operation of the fixing belt 72. Then, the control circuit 108 changes and updates the abnormality detection threshold value Vk in response to the changes of the input voltage Vin and the input electric power Win. Therefore, the control circuit 108 functions as a threshold value changing unit.

Thus, since the abnormality of the fixing belt 72 is detected while the input voltage Vin is also taken into consideration, the abnormality of the fixing belt 72 can be detected accurately and stably.

That is, even if operating conditions, such as an AC input voltage and input electric power, change, the abnormality of the fixing belt 72 is detected accurately, and variation in the determination of damage of the fixing belt 72 can be reduced.

It should be noted that the control circuit 108 has a detecting function to detect the abnormality of the fixing belt 72 other than the threshold value changing function mentioned above.

Since the abnormality of the fixing belt 72 can be detected accurately as mentioned above, the criteria of determination for the damage are unified at the same percentage of the abnormality area by changing the abnormality detection threshold value according to change of AC input voltage, even if the image forming apparatus is made universal and a range of a usable alternating voltage spreads. As compared with the conventional case where the abnormality detection threshold value is set corresponding to the voltage higher than actual AC input voltage in consideration of the range of the AC input voltage, a damage is determined in a earlier stage (in condition that an abnormality area is small), and waste of recording sheets, toner, etc. can be prevented.

Although the above-mentioned embodiment employs the series resonance type IH power-supply unit 100, the similar effect is also obtained using power-supply units of other types, such as a parallel resonance type etc.

Although the antenna 80 is arranged so as to face the coil 71 and to interpose the fixing belt 72 therebetween in the example shown in FIG. 2, the position of the antenna 80 is not limited to this example. Anyway, what is necessary is just to arrange the antenna 80 at a position where the change of magnetic flux distribution can be detected when an abnormality occurs in the fixing belt 72.

In the above-mentioned example, the input electric power to the IH power-supply unit 100 is calculated by detecting the input current to the IH power-supply unit 100 by the input current detection unit 114 and by detecting the input voltage to the IH power-supply unit 100 by the input voltage detection unit 113. Instead the input electric power may be calculated based on the voltage detection result by the input voltage detection unit 113 and the current detection result of the current that flows in the coil 71.

In addition, although the abnormality detection threshold value Vk concerning the abnormality detection of the fixing belt 72 is changed in response to the input voltage Vin and the input electric power Win in the above-mentioned example, the antenna output Va from the detector circuit 81 may be corrected according to the input voltage Vin and the input electric power Win in the same manner. Moreover, both the abnormality detection threshold value Vk and the antenna output Va may be corrected.

Although the above-mentioned example described the case where the abnormality of the fixing belt 72 is detected, an abnormality of a heating roller is detected when the fixing device 7 is a type to fix an unfixed toner image on a recording sheet P by the heating roller.

Figure 9:
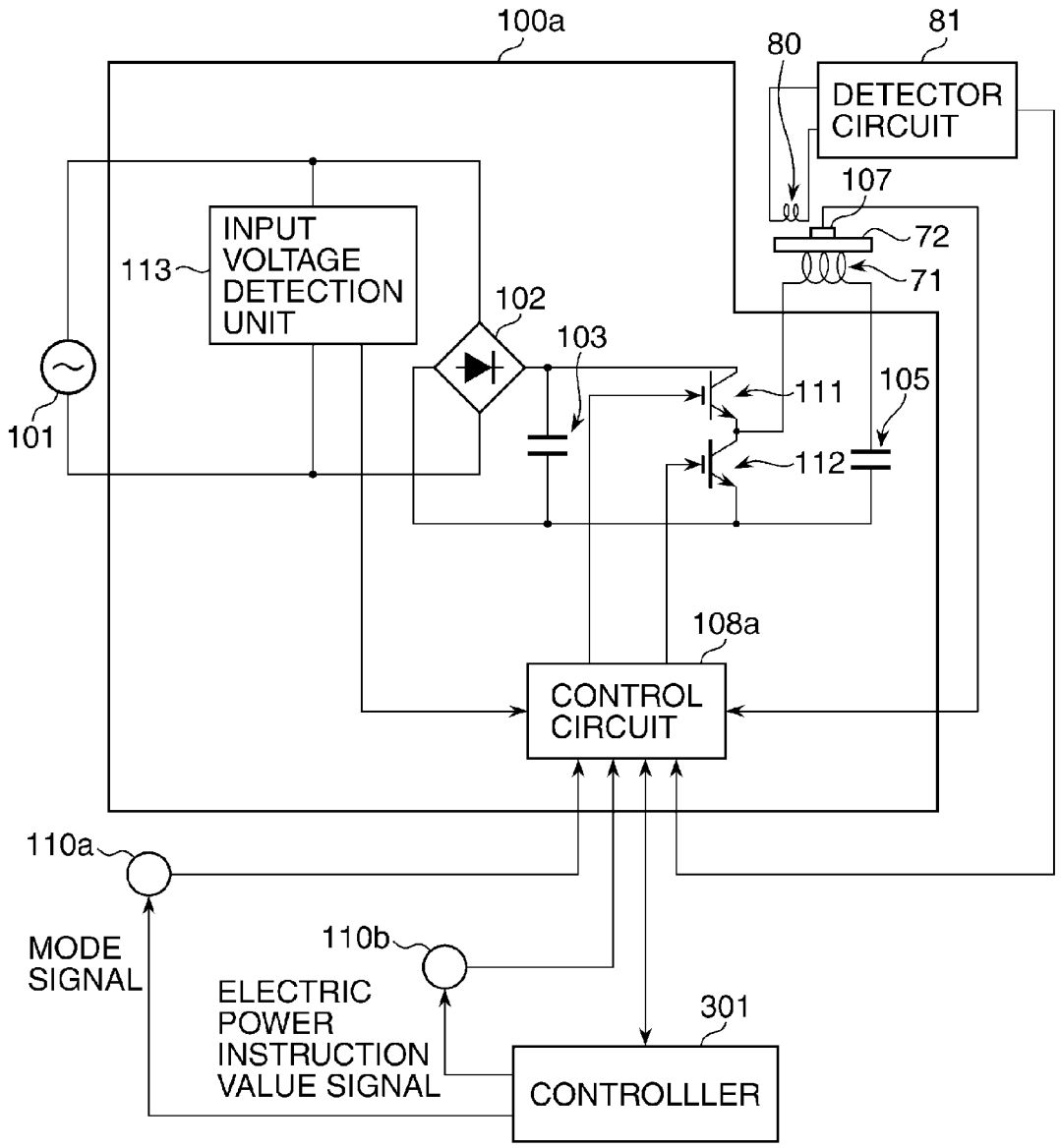
FIG. 9 is a circuit diagram showing another example of an IH power-supply unit used in the heating control device shown in FIG. 4.
Figure 10:
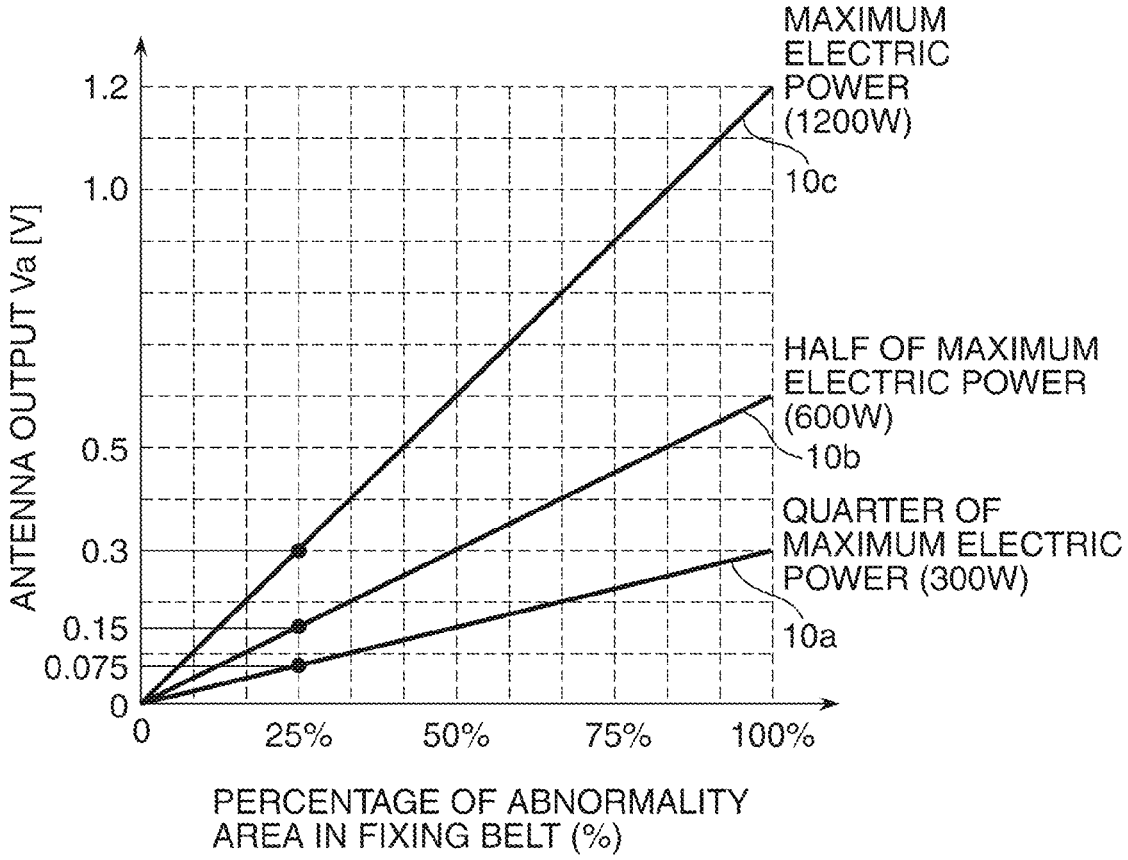
FIG.10 (PRIOR ART)
FIG. 10 is a graph showing a relationship between an antenna output and a percentage of an abnormality area in a fixing belt in the conventional heating control device.

FIG. 9 is a view showing another example of the IH power-supply unit 100*a* used in the heating control device shown in FIG. 4.

In FIG. 9, the same reference numerals are attached to the elements same as that in FIG. 5, and the descriptions are omitted. In the IH power-supply unit 100*a* shown in FIG. 9, since a control circuit has different functions from that of the control circuit 108 shown in FIG. 5, the reference numeral 108*a* is attached.

The controller 301 shown in FIG. 4 gives an electric power instruction value signal, for example, a power instruction PWM (pulse width modulation) signal to the illustrated control circuit 108*a*, other than the mode signals.

In the electric power control mode, the controller 301 (FIG. 4) gives the electric power instruction PWM signal and the electric power control mode signal to the IH power-supply unit 100. In the electric power control mode, the control circuit 108*a* adjusts ON/OFF times of the electric power instruction PWM signal according to the input voltage Vin that is indicated by the input voltage detection signal from the input voltage detection unit 113.

For example, the control circuit 108*a* compares a predetermined voltage value to the input voltage Vin. Then, when the input voltage Vin is larger than the predetermined voltage value, the control circuit 108*a* shortens the ON time of the electric power instruction PWM signal in response to the difference between the predetermined voltage value and the input voltage Vin, and replaces the electric power instruction PWM signal with a corrected PWM signal.

On the other hand, when the input voltage Vin is smaller than the predetermined voltage value, the control circuit 108*a* lengthens the ON time of the electric power instruction PWM signal in response to the difference, and replaces the electric power instruction PWM signal with a corrected PWM signal.

Then, the control circuit 108*a* controls the ON/OFF conditions of the first and second switch elements 111 and 112 in response to the first and second control signals based on the correction PWM signal. It should be noted that when the input voltage Vin is equal to the predetermined voltage value, the control circuit 108*a* does not adjust the electric power instruction PWM signal.

In the illustrated IH power-supply unit 100*a*, when the abnormality of the fixing belt 72 is detected, the abnormality detection threshold value Vk is determined by searching the abnormality detection threshold value table described in FIG. 7 according to the input voltage Vin and the electric power instruction value Wa that is indicated by the electric power instruction PWM signal. Then, as described in FIG. 8, the control circuit 108*a* determines about whether the fixing belt 72 has damaged.

Since the other operations are the same as that of the IH power-supply unit 100 shown in FIG. 5, the descriptions are omitted.

In this case, since the abnormality detection threshold value Vk is determined by searching the abnormality detection threshold value table according to the input voltage Vin and the electric power instruction value Wa, there are disadvantages in the abnormality detection accuracy and the time required to detect the abnormality as compared with the IH power-supply unit 100 shown in FIG. 5.

However, in the IH power-supply unit shown in FIG. 9, since the input current detection unit 114 shown in FIG. 5 becomes unnecessary, there is an advantage in the simple configuration with a fewer component count.

Then, since the input current detection unit 114 is not included, it is unnecessary to calculate the input electric power Win unlike the IH power-supply unit 100 shown in FIG. 5. As a result, the IH power-supply unit 100*a* also has the advantage that the configuration becomes simple compared with the IH power-supply unit 100.

In the above-mentioned example, the fixing belt 72 in the fixing device 7 is the object to be heated, and the method of detecting the abnormality of the fixing belt 72 has been described. However, when the fixing device fixes a toner image by a fixing roller, the fixing roller will be an object to be heated. The present invention can be applied to detect the abnormality of the object to be heated by electromagnetic induction other than the fixing device 7.

As is evident from the above description, the power-supply unit 100 or 100*a* functions as the power-supply unit that applies a high-frequency electric power to the electromagnetic induction heating coil 71. The antenna 80 and the detector circuit 81 function as the flux detecting unit that detects the magnetic flux emitted from the electromagnetic induction heating coil 71 across the fixing belt 72 that is an object to be heated, and outputs the voltage in response to the magnetic flux concerned as the detected magnetic flux voltage value (the antenna output).

Then, the control circuit 108 or 108*a* functions as the changing unit that changes at least one of the magnetic flux voltage value and the abnormality detection threshold value in response to the relationship between the power set value that define the electric power value of the high-frequency electric power and the input voltage inputted into the power-supply unit 100 or 100*a*. The control circuit 108 or 108*a* also functions as the abnormality determining unit that determines the abnormality of the fixing belt 72 according to the magnetic flux voltage value and the abnormality detection threshold value that has been changed.

It should be noted that the control circuit 108 or 108*a* has the abnormality detection threshold value table that defines a plurality of abnormality detection threshold values associated with the above-mentioned electric power set values and the input voltages. The control circuit 108 or 108*a* searches the abnormality detection threshold value table according to the electric power set value and the input voltage, and obtains one abnormality detection threshold value to set the abnormality detection threshold value.

The control circuit 108 or 108*a* and the first and second switch elements 111 and 112 function as the first electric power control unit that controls the power-supply unit 100 or 100*a* based on the detected temperature detected by the temperature sensor 72 and the predetermined temperature to adjust the high-frequency electric power given to the electromagnetic induction heating coil 71.

The control circuit 108 or 108*a* and the first and second switch elements 111 and 112 function as the second electric power control unit that controls the power-supply unit 100 or 100*a* based on the input voltage to the power-supply unit 100 or 100*a* and the predetermined electric power to adjust the high-frequency electric power given to the electromagnetic induction heating coil 71.

The control circuit 108 or 108*a* and the first and second switch elements 111 and 112 function as the stopping unit that stops the power-supply unit 100 or 100*a* when the detected magnetic flux voltage value is larger than the abnormality detection threshold value.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-106403, filed on May 6, 2010, which is hereby incorporated by reference herein in its entirety.

What is claimed is:

1. An image forming apparatus comprising:

an image forming unit configured to form an image on a sheet; and a fixing unit configured to fix the image formed on the sheet by the image forming unit, wherein the fixing unit comprises:

a coil unit configured to generate a magnetic flux;

a heat generating member configured to receive the magnetic flux generated by the coil unit to generate heat, thereby fixing the image formed on the sheet by the image forming unit;

a temperature detecting unit configured to detect a temperature of the heat generating member;

a voltage detecting unit configured to detect a commercial electric voltage that is output directly by a commercial electric power source;

an electric power control unit configured to control electric power to be supplied to the coil unit from the commercial electric power source, based on the temperature detected by the temperature detecting unit and the commercial electric voltage detected by the voltage detecting unit;

an outputting unit configured to output an output value varying in response to an amount of the magnetic flux detected by a detecting member disposed oppositely to the coil unit with respect to the heat generating member;

a prohibiting unit configured to prohibit the electric power from being supplied to the fixing unit from the commercial electric power when the output value output from the outputting unit exceeds a threshold value; and a determining unit configured to determine the threshold value based on the commercial electric voltage detected by the voltage detecting unit and the electric power controlled by the electric power control unit.

2. The image forming apparatus as claimed in claim 1, wherein:

the electric power control unit further includes a switching element configured to supply the electric power to the coil unit, and the electric power control unit controls the switching element based on the temperature detected by the temperature detecting unit and the commercial electric voltage detected by the voltage detecting unit.

3. The image forming apparatus as claimed in claim 1, further comprising:

a current detecting unit configured to detect a commercial electric current that is output directly by the commercial electric power source, wherein the determining unit determines the threshold value based on the commercial electric voltage detected by the voltage detecting unit and the commercial electric current detected by the current detecting unit.

4. The image forming apparatus as claimed in claim 1, further comprising:

a memory configured to store threshold value data associated with the commercial electric voltage detected by the voltage detecting unit and the electric power to be supplied to the coil unit, wherein the determining unit determines the threshold value from the threshold value data stored in the memory based on the commercial electric voltage detected by the voltage detecting unit and the electric power controlled by the electric power control unit.

5. An image forming apparatus comprising:

an image forming unit configured to form an image on a sheet; and a fixing unit configured to fix the image formed on the sheet by the image forming unit, wherein the fixing unit comprises:

a coil unit configured to generate a magnetic flux;

a heat generating member configured to receive the magnetic flux generated by the coil unit to generate heat, thereby fixing the image formed on the sheet by the image forming unit;

a temperature detecting unit configured to detect a temperature of the heat generating member;

a voltage detecting unit configured to detect a commercial electric voltage output directly by a commercial electric power source;

an electric power control unit configured to control electric power to be supplied to the coil unit from the commercial electric power source, based on the temperature detected by the temperature detecting unit and the commercial electric voltage detected by the voltage detecting unit;

an outputting unit configured to output an output value varying in response to an amount of the magnetic flux detected by a detecting member disposed oppositely to the coil unit with respect to the heat generating member;

a correcting unit configured to correct the output value based on the commercial electric voltage detected by the voltage detecting unit and the electric power controlled by the electric power control unit; and a prohibiting unit configured to prohibit the electric power from being supplied to the fixing unit from the commercial electric power supply in a case where the output value is corrected by the correcting unit exceeds a threshold value.

6. The image forming apparatus as claimed in claim 5, wherein:

the electric power control unit further includes a switching element configure to supply the electric power to the coil unit, and the electric power control unit controls the switching element based on the temperature detected by the temperature detecting unit and the commercial electric voltage detected by the voltage detecting unit.

7. The image forming apparatus as claimed in claim 5, further comprising:

a current detecting unit configured to detect a commercial electric current directly output by the commercial electric power source, wherein the correcting unit corrects the output value based on the commercial electric voltage detected by the voltage detecting unit and the commercial electric current detected by the current detecting unit.

* * * * *